United States Patent [19]

Arai

[11] Patent Number: 5,001,807

[45] Date of Patent: Mar. 26, 1991

[54] DUST COLLECTOR

[75] Inventor: Hiroshi Arai, Tokyo, Japan

[73] Assignee: Nippon Lissajou Co., Ltd., Tokyo, Japan

[21] Appl. No.: 416,383

[22] Filed: Oct. 3, 1989

[30] Foreign Application Priority Data

Oct. 7, 1988 [JP] Japan ..... 63-253416

[51] Int. Cl.[5] ..... A47L 9/00

[52] U.S. Cl. ..... 15/347; 15/352

[58] Field of Search ..... 15/352, 347

[56] References Cited

U.S. PATENT DOCUMENTS

| | | | |
|---|---|---|---|
| 4,325,162 | 4/1982 | Chambers et al. | 15/352 X |
| 4,342,131 | 8/1982 | Reid | 15/352 X |
| 4,355,434 | 10/1982 | Gongwer | 15/352 X |
| 4,363,674 | 12/1982 | Fullenwider | 15/301 X |
| 4,476,608 | 10/1984 | Rasmussen | 15/352 X |
| 4,739,535 | 4/1988 | Schuld et al. | 15/352 X |
| 4,847,943 | 7/1989 | Blase et al. | 15/352 |
| 4,868,949 | 9/1989 | Loveless et al. | 15/352 |

FOREIGN PATENT DOCUMENTS

| | | | |
|---|---|---|---|
| 654433 | 6/1951 | United Kingdom | 15/327 R |

*Primary Examiner*—Ernest G. Cusick
*Assistant Examiner*—Robert M. Fetsuga
*Attorney, Agent, or Firm*—Hoffmann & Baron

[57] ABSTRACT

A dust collector comprising a dust-collector body having a built-in suction fan, a flexible hose connected to the dust-collector body, and a nozzled non-flammable dust-collecting case connected to the tip end of the flexible hose. Objects sucked in through the nozzle are gathered in the non-flammable dust-collecting case, and are not allowed to enter the succeeding flexible hose and the dust-collector body.

8 Claims, 2 Drawing Sheets

DUST COLLECTOR

BACKGROUND OF THE INVENTION

This invention relates to a dust collector of the type which comprises a dust-collector body having a built-in suction fan, a flexible hose connected to the dust-collector body, and a nozzle provided at the tip end of the flexible hose, and which is capable of sucking in burning objects and liquids.

In a dust collector of the type equipped with a flexible hose, the dust-collecting case is usually arranged within the dust-collector body along with the built-in suction fan.

If such a dust collector is to be capable of sucking in burning objects or liquids, its hose must be non-flammable or liquid-proof. In addition, the inner diameter of the hose must inevitably be enlarged so that cigarette butts, matchstick stems or the like will not get caught in it because of its flexibility. The dust collector must then be accordingly powerful, resulting in an excessive consumption of electric power and an apparatus size which is too large for a portable dust collector.

SUMMARY OF THE INVENTION

It is accordingly an object of this invention to provide a dust collector which is capable of sucking in burning objects and liquids, for example, cigarette butts, and which can be produced as an inexpensive and small-sized apparatus.

In accordance with this invention, this object is attained with a structure in which a dust-collecting case equipped with a non-flammable nozzle is provided at the tip end of the flexible hose which is connected to the a dust-collector body having a built-in suction fan.

In the dust collector of this invention, objects which are sucked in through the nozzle are gathered in a non-flammable dust-collecting tank, and are not allowed to pass through the flexible hose extending from this tank to the dust-collector body. Accordingly, there is no need for the flexible hose to be made of a non-flammable material. Nor is it necessary to enlarge the inner diameter of the hose so that matchstick stems, toothpicks or the like will not get caught in it. Thus, the dust collector of this invention is particularly suited to be used for sucking in burning objects including such bar-like ones, and is energy-saving, small-sized, light-weight and inexpensive. Since burning objects can be held in the dust-collecting case, the dust collector of this invention is superior in safety to prior art devices.

Further, the non-flammable and liquid-tight dust-collecting case having a nozzle may be equipped with a tank containing a fire-extinguishing liquid, which is poured on objects sucked in, thereby making it possible to reliably extinguish them. This arrangement will help to further enhance the safety of the dust collector.

The dust-collector body may be equipped with a built-in storage battery which can be charged. This helps to realize a portable dust collector which is small-sized, light-weight and cordless. With this dust collector, a large number of cigarette butts scattered in various places can be removed efficiently.

DETAILED DESCRIPTION OF THE PREFERRED EMBODIMENTS

An embodiment this invention will now be described with reference to the accompanying drawings.

Figure 1:
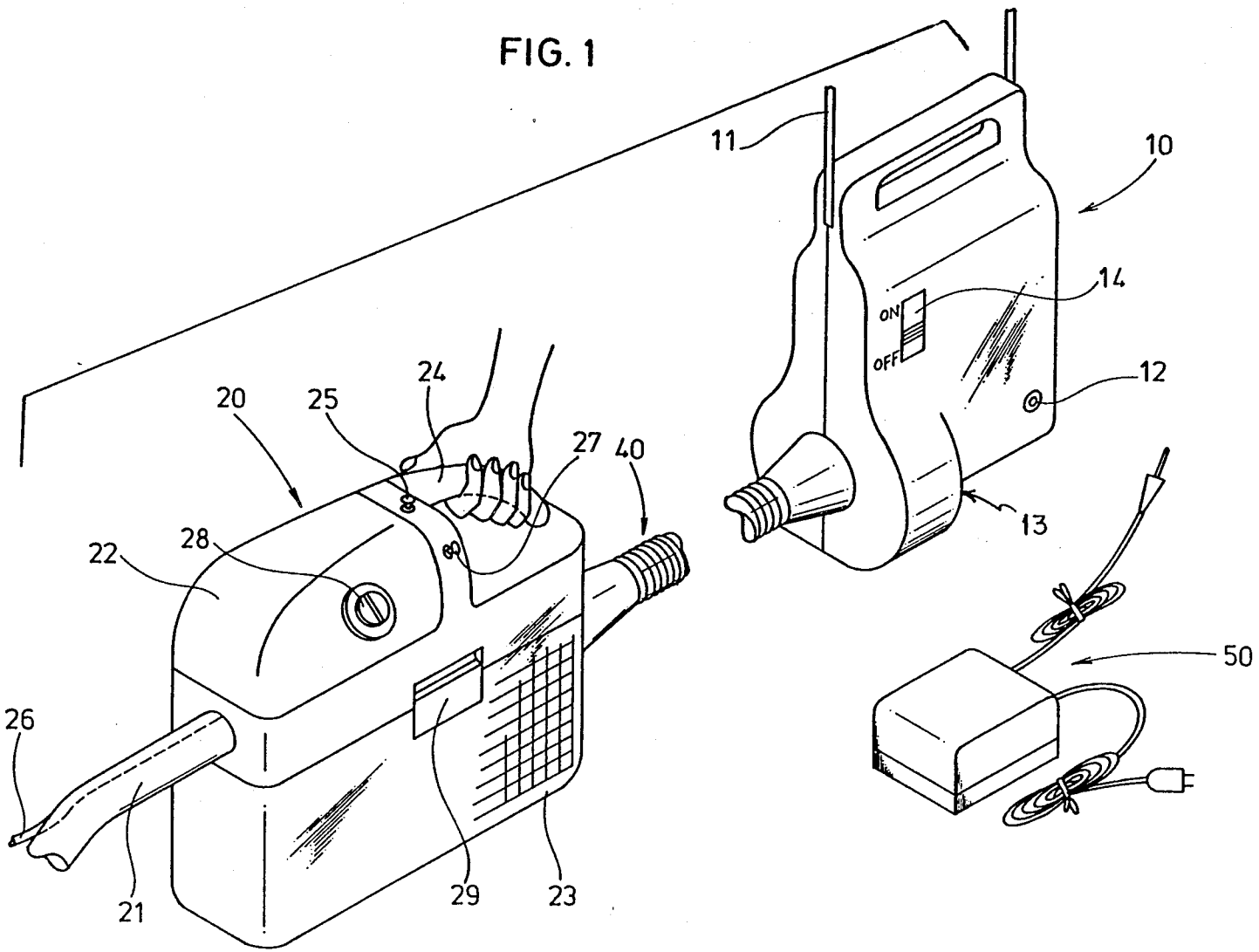
FIG. 1 is a perspective view of a portable dust collector in accordance with an embodiment of this invention.
Figure 2:
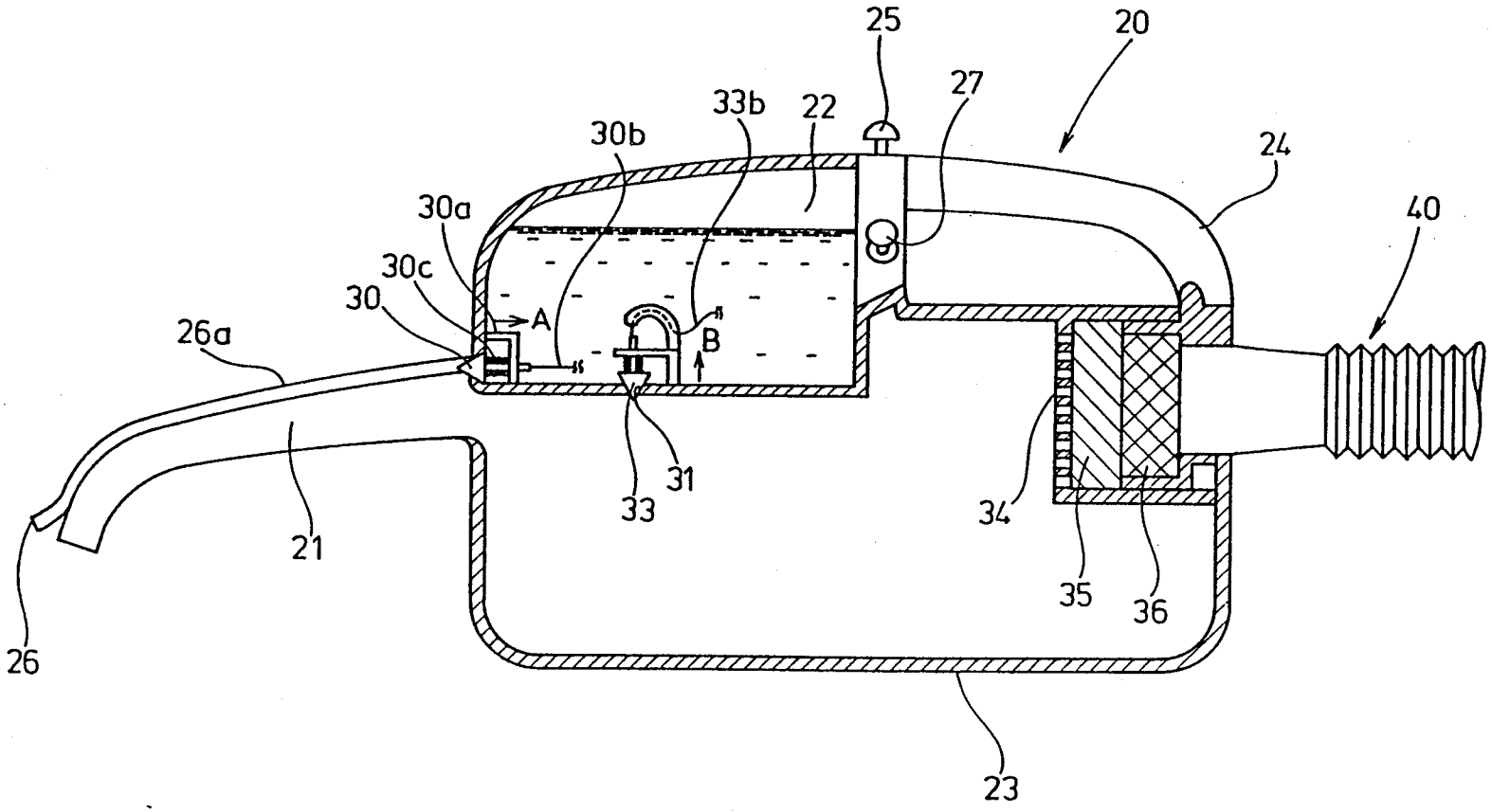
FIG. 2 is a sectional view showing the inner structure of the essential part of this embodiment.

FIGS. 1 and 2 show a portable dust collector in accordance with an embodiment of this invention.

Referring to FIG. 1, the reference numeral 10 indicates a dust-collector body which is equipped with a shoulder strap 11. This dust-collector body 10 contains a storage battery which is charged with a D.C. voltage supplied from a battery charger 50 through a connector 12, as well as a D.C. motor connected to a suction fan 13 and adapted to be driven by this storage battery. The dimensions of this dust-collector body 10 may, for example, be 95 (width)×200 (depth)×270 (height) mm. When a switch 14 mounted on the dust-collector body 10 is turned on, a suction airflow is generated which flows from a flexible hose 40 connected to the front section of the dust-collector body 10 toward an air outlet (not shown) provided in the rear. This mechanism is well known in itself, so that a detailed description thereof will not be given here.

The reference numeral 20 indicates a dust-collecting case equipped with a nozzle 21 protruding forwardly and made of a non-flammable material such as metal or a fire-proof plastic. The rear section of this dust-collecting case 20 is connected to the tip end of the flexible hose 40. The dimensions of this dust-collecting case 20 may, for example, be 90 (width)×200 (depth)×250 (height) mm. Provided in the upper section of the dust-collecting case 20 are a handle 24 as well as a water tank 22 which is equipped with a cover 28 for water supply and which is detachably mounted on the dust-collecting case 20 in a water-tight manner by means of a clamp 29. The bottom section of the water tank 22 as well as the inner section of the collecting-case body 23 communicating with the nozzle 21 are also made of a non-flammable or fire-proof material and are made water-tight taking into account the nature of the objects to be sucked in, for example, cigarette butts. The dust-collecting case 20 is further equipped with an operating knob 25 for ejecting water through the nozzle 21 and an operating knob 27 for injecting water into the dust-collecting-case body 23.

FIG. 2 shows the inner structure of the dust-collecting case 20. Provided at the tip end of the nozzle 21 is a port 26 communicating with the water tank 22 through a tube **26*a* extending along this nozzle. The water tank 22 includes an outlet communicating with the base end of this tube 26*a*. Arranged at this outlet is a valve member 30 adapted to be opened in the direction indicated by the arrow A when the operating knob 25** is depressed.

This valve member 30 is slidably guided by an arm **30*a* and is biased in the closing direction by a spring 30*c*. At the same time, this valve member 30 is connected to a wire 30*b* which is connected to the operating knob 25 through an associated lever mechanism (not shown). When the knob 25 is depressed, the wire 30*b* is pulled in the direction indicated by the arrow A by virtue of the lever mechanism mentioned above. A water-injection port 31 is provided at the bottom of the water tank 22 along with an associated valve member 33, which is likewise opened in the direction indicated by the arrow B against the resilient force of an associated spring when the operating knob 27** is depressed.

Further, arranged in the dust-collecting case 23 are a fire-proof filter 35 and an ordinary filter 36 which are covered with a metal draft material 34. These filters 35 and 36 communicate with the inner space of the dust-collector body 10 through the flexible hose 40.

When using the dust collector, the operator carries the charged dust-collector body 10 by the shoulder strap 11, and carries the dust-collecting case 20 by the handle 24. When cleaning an ashtray or the like which can contain burning cigarette butts, the operating knob 25 is first depressed so as to completely extinguish the embers beforehand by ejecting water through the port 26. The switch 14 is then turned on to suck in the cigarette butts or the like through the nozzle 21. The suction airflow, thereby generated, flows through the flexible hose 40, which offers little resistance since no objects sucked in are allowed to enter it, imparting a strong sucking power to the nozzle 21. After the sucking, the operating knob 27 is depressed to inject water through the water-injection port 31, sprinkling the sucked objects in the dust-collecting-case body 23 with water utilizing the airflow generated therein, thereby extinguishing the embers still more reliably. If it is undesirable to use the operating knob 25 because of the nature of the objects to be sucked in or the condition around them, the embers can be extinguished by manipulating the operating knob 27. During the sucking operation, the dust-collector body 10 can be placed on the floor or hung on the wall or the like.

In a modification of the above-described embodiment, either the water port 21 or the water-injection port 31 may be omitted. In another modification, the water tank 22 may be dispensed with. In that case, objects sucked in through the nozzle are likewise gathered in the non-flammable dust-collecting case situated immediately behind the nozzle. Accordingly, no bar-like or burning objects are allowed to enter the flexible hose, so that it is not necessary to employ special materials or a structure in view of such objects, which likewise makes it possible to make the entire apparatus small-sized, light-weight and inexpensive. Further, by making the nozzled dust-collecting case non-flammable and liquid-tight, liquids can be sucked in, too.

The battery charger may be installed in the portable dust collector. The nozzle and the dust-collecting case may not only be water-proof, but may be made, at least partly, of a liquid-chemical-proof or solid-chemical-proof material, according to the use. Other liquids than water may be employed as the fire-extinguishing liquid.

What is claimed is:

1. A dust collector comprising:

a vacuum body;

a suction fan contained within said vacuum body;

a non-flammable, hand-portable, liquid-tight dust-collecting case defining a chamber, said dust-collecting case including a fire-extinguishing liquid tank including means for sprinkling objects within said chamber;

a non-flammable nozzle protruding forwardly from said dust-collecting case and communicating with said chamber;

handle means connected to an upper portion of said dust-collecting case; and a flexible hose connected between said vacuum body and said dust-collecting case such that objects can be sucked into said chamber through said nozzle when said suction fan is actuated.

2. The dust collector of claim 1 including a liquid tank, a tube extending along said nozzle, said tube including a port, a valve member for controlling fluid communication between said tank and said tube, and means for manipulating said valve member, whereby liquid from said tank may be ejected from said port when said valve is in a first position.

3. The dust collector of claim 1 including a valve member communicating with said fire-extinguishing liquid tank and said chamber; and means for manipulating said valve member.

4. The dust collector of claim 5 wherein said dust-collecting case and said nozzle are made from a chemical-proof material.

5. The dust collector of claim 1 wherein said vacuum body includes a shoulder strap which allows said vacuum body to be carried.

6. The dust collector of claim 1 wherein said nozzle is connected directly to said dust-collecting case and is made from a rigid material.

7. The dust collector of claim 1 wherein said dust-collecting case including filtering means for preventing objects sucked into said chamber from entering said vacuum body.

8. A dust collector comprising:

a vacuum body;

a suction fan contained within said vacuum body;

a non-flammable, hand-portable, dust-collecting case defining a chamber;

a non-flammable nozzle protruding forwardly from said dust-collecting case and communicating with said chamber;

handle means connected to an upper portion of said dust-collecting case; and a flexible hose connected between said vacuum body and said dust-collecting case such that objects can be sucked into said chamber through said nozzle when said suction fan is actuated, said dust-collecting case including a fire-extinguishing liquid tank for sprinkling objects received within said chamber;

said non-flammable nozzle including a tube having a forward end and a rearward end, said forward end of said tube including a port adjacent to an end of said non-flammable nozzle, said rearward end of said tube being communicable with said fire-extinguishing liquid tank;

said fire-extinguishing liquid tank including a first valve member communicating with said fire extinguishing liquid tank and said tube;

said dust-collecting case including a first operating knob for manipulating said first valve member to eject a fire-extinguishing liquid into said tube;

said fire-extinguishing liquid tank including a second valve member communicating with said fire-extinguishing liquid tank and said chamber; and said dust-collecting case including a second operating knob for manipulating said second valve member to eject a fire-extinguishing liquid into said chamber.

* * * * *

UNITED STATES PATENT AND TRADEMARK OFFICE

CERTIFICATE OF CORRECTION

PATENT NO. : 5,001,807

DATED : March 26, 1991

INVENTOR(S) : Hiroshi Ari

It is certified that error appears in the above-identified patent and that said Letters Patent is hereby corrected as shown below:

In Column 2, Line 6, before "this", insert --of--.

Column 4, Line 16, after "of", change "claim 5" to --claim 1--.

Column 4, Line 26, after "case", change "including" to --includes--.

Signed and Sealed this

Twenty-fifth Day of August, 1992

*Attest:*

DOUGLAS B. COMER

*Attesting Officer*

*Acting Commissioner of Patents and Trademarks*